US008191799B2

(12) United States Patent
Chen

(10) Patent No.: US 8,191,799 B2
(45) Date of Patent: Jun. 5, 2012

(54) SHOWER HEAD HAVING A LARGER FLUSHING ANGLE

(75) Inventor: Kun-Chih Chen, Changhua Hsien (TW)

(73) Assignee: Sunrise Shower Products Co. Ltd., Changhua (TW)

( * ) Notice: Subject to any disclaimer, the term of this patent is extended or adjusted under 35 U.S.C. 154(b) by 213 days.

(21) Appl. No.: 12/773,058

(22) Filed: May 4, 2010

(65) Prior Publication Data

US 2011/0272491 A1 Nov. 10, 2011

(51) Int. Cl.
*E03C 1/08* (2006.01)

(52) U.S. Cl. ..... 239/428.5; 239/553; 239/587.4; 239/590

(58) Field of Classification Search ..... 239/423, 239/425.5, 428.5, 433, 434, 553, 587.4, 590
See application file for complete search history.

(56) References Cited

U.S. PATENT DOCUMENTS 2,156,800 A * 5/1939 Bucknell et al. ..... 239/457
2,557,106 A * 6/1951 Hughes ..... 239/438
3,322,352 A * 5/1967 Alcantara ..... 239/428.5
4,346,844 A * 8/1982 Harmony ..... 239/381
4,573,639 A * 3/1986 Logue ..... 239/428.5
5,111,994 A * 5/1992 Gonzalez ..... 239/428.5
5,154,355 A * 10/1992 Gonzalez ..... 239/428.5
5,826,799 A * 10/1998 Hsieh ..... 239/428.5
6,343,750 B1 * 2/2002 Engel ..... 239/463
6,796,518 B2 * 9/2004 Douglas et al. ..... 239/587.4
7,611,070 B2 * 11/2009 Paoluccio ..... 239/9
7,975,936 B2 * 7/2011 Paoluccio ..... 239/9

* cited by examiner

*Primary Examiner* — Christopher Kim
(74) *Attorney, Agent, or Firm* — Che-Yang Chen Law Office of

(57) ABSTRACT

A shower head includes a nozzle, a connector mounted on the nozzle, a fastening member secured on the nozzle and abutting the connector, a bushing mounted in the connector, and a locking screw member locked onto the connector. Thus, when the water flows through the shower head, the ambient air is introduced through the air conducting holes of the connector and the air conducting apertures of the bushing into the flow conduit of the bushing to break the vacuum state in the shower head and to perturb the water flow in the shower head so as to produce a turbulent flow in the shower head so that the water flow injected from the nozzle is divided into multiple straight water beams and multiple irregular water bubbles so as to increase the flushing angle and area of the shower head.

4 Claims, 6 Drawing Sheets

SHOWER HEAD HAVING A LARGER FLUSHING ANGLE

BACKGROUND OF THE INVENTION

1. Field of the Invention

The present invention relates to a shower head and, more particularly, to a shower head for a bathroom.

2. Description of the Related Art

A conventional shower head 70 in accordance with the prior art shown in FIGS. 5 and 6 comprises a nozzle 74, a connector 73 mounted on an open top of the nozzle 74, a sealing ring 742 mounted in the open top of the nozzle 74 and located between the connector 73 and the nozzle 74, a fastening member 72 secured on the open top of the nozzle 74 and abutting the connector 73 to limit the connector 73 on the nozzle 74, and a locking screw member 71 locked onto the connector 73. The nozzle 74 has a peripheral wall provided with a control handle 741 to regulate a water flow injected from the nozzle 74. The open top of the nozzle 74 has an outer portion formed with an outer threaded portion 743. The connector 73 has a first end provided with a spherical body 732 rotatably mounted on the open top of the nozzle 74 and abutting the sealing ring 742 and has a second end provided with a threaded tube 731. The connector 73 has an inner portion formed with a mounting hole 733. The mounting hole 733 of the connector 73 has a bottom formed with a reduced water outlet 734. The fastening member 72 has an inner wall formed with an inner threaded portion 722 screwed onto the outer threaded portion 743 of the nozzle 74 to lock the fastening member 72 onto of the nozzle 74. The fastening member 72 has a top formed with a reduced limit hole 721 mounted on the spherical body 732 of the connector 73 so that the threaded tube 731 of the connector 73 protrudes outward from the limit hole 721 of the fastening member 72. The locking screw member 71 has a first end formed with a screw bore 712 screwed onto the threaded tube 731 of the connector 73 to lock the locking screw member 71 onto the connector 73. The locking screw member 71 has a second end formed with a water inlet port 711 that is connected to a water source (not shown). In operation, when the water inlet port 711 of the locking screw member 71 is connected to the water source, the water from the water source in turn flows through the water inlet port 711 of the locking screw member 71, the mounting hole 733 of the connector 73 and the water outlet 734 of the connector 73 into the nozzle 74 and is injected outward from the nozzle 74 for use with a user.

However, when the water inlet port 711 of the locking screw member 71 is connected to the water source, a closed vacuum condition is formed in the inner space of the shower head 70 so that the inner space of the shower head 70 has a larger water pressure to push and inject the water from the nozzle 74 quickly and violently to form multiple concentrated and convergent water beams, thereby decreasing the flushing angle and area of the shower head 70. In addition, the water beams are injected outward from the nozzle 74 strongly due to the larger water pressure in the shower head 70, thereby easily causing an uncomfortable sensation to the user.

BRIEF SUMMARY OF THE INVENTION

In accordance with the present invention, there is provided a shower head, comprising a nozzle, a connector mounted on an open top of the nozzle, a sealing ring mounted in the open top of the nozzle and located between the connector and the nozzle, a fastening member secured on the open top of the nozzle and abutting the connector to limit the connector on the nozzle, a bushing mounted in the connector, and a locking screw member locked onto the connector.

The open top of the nozzle has an outer portion formed with an outer threaded portion. The connector has a first end provided with a spherical body rotatably mounted on the open top of the nozzle. The connector has a second end provided with a threaded tube. The connector has an inner portion formed with a mounting hole. The mounting hole of the connector has a peripheral wall formed with two radially opposite limit portions. The connector has a peripheral wall formed with two radially opposite air conducting holes. The air conducting holes of the connector are connected to the mounting hole. The fastening member has an inner wall formed with an inner threaded portion screwed onto the outer threaded portion of the nozzle to lock the fastening member onto of the nozzle. The fastening member has a top formed with a limit hole mounted on the spherical body of the connector. The bushing is received in the mounting hole of the connector. The bushing has an outer wall formed with two radially opposite locking portions locked in the limit portions of the connector respectively. The bushing has an inner wall formed with a flow conduit connected to the mounting hole of the connector. The bushing has a peripheral wall formed with two radially opposite air conducting apertures aligning with the air conducting holes of the connector respectively. The air conducting apertures of the bushing are connected to the flow conduit. The locking screw member has a first end formed with a screw bore screwed onto the threaded tube of the connector to lock the locking screw member onto the connector. The locking screw member has a second end formed with a water inlet port.

The primary objective of the present invention is to provide a shower head having a larger flushing angle.

According to the primary advantage of the present invention, when the water flows through the shower head, the ambient air is introduced through the air conducting holes of the connector and the air conducting apertures of the bushing into the flow conduit of the bushing to break the vacuum state in the shower head and to perturb the water flow in the shower head so as to produce a turbulent flow in the shower head so that the water flow injected from the nozzle is broken and divided into multiple straight water beams and multiple irregular water bubbles so as to increase the flushing angle and area of the shower head and to enhance the water flushing effect of the shower head.

According to another advantage of the present invention, the ambient air is introduced through the air conducting holes of the connector and the air conducting apertures of the bushing into the flow conduit of the bushing to reduce the water pressure in the shower head so that the water is injected from the nozzle smoothly and stably so as to provide a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
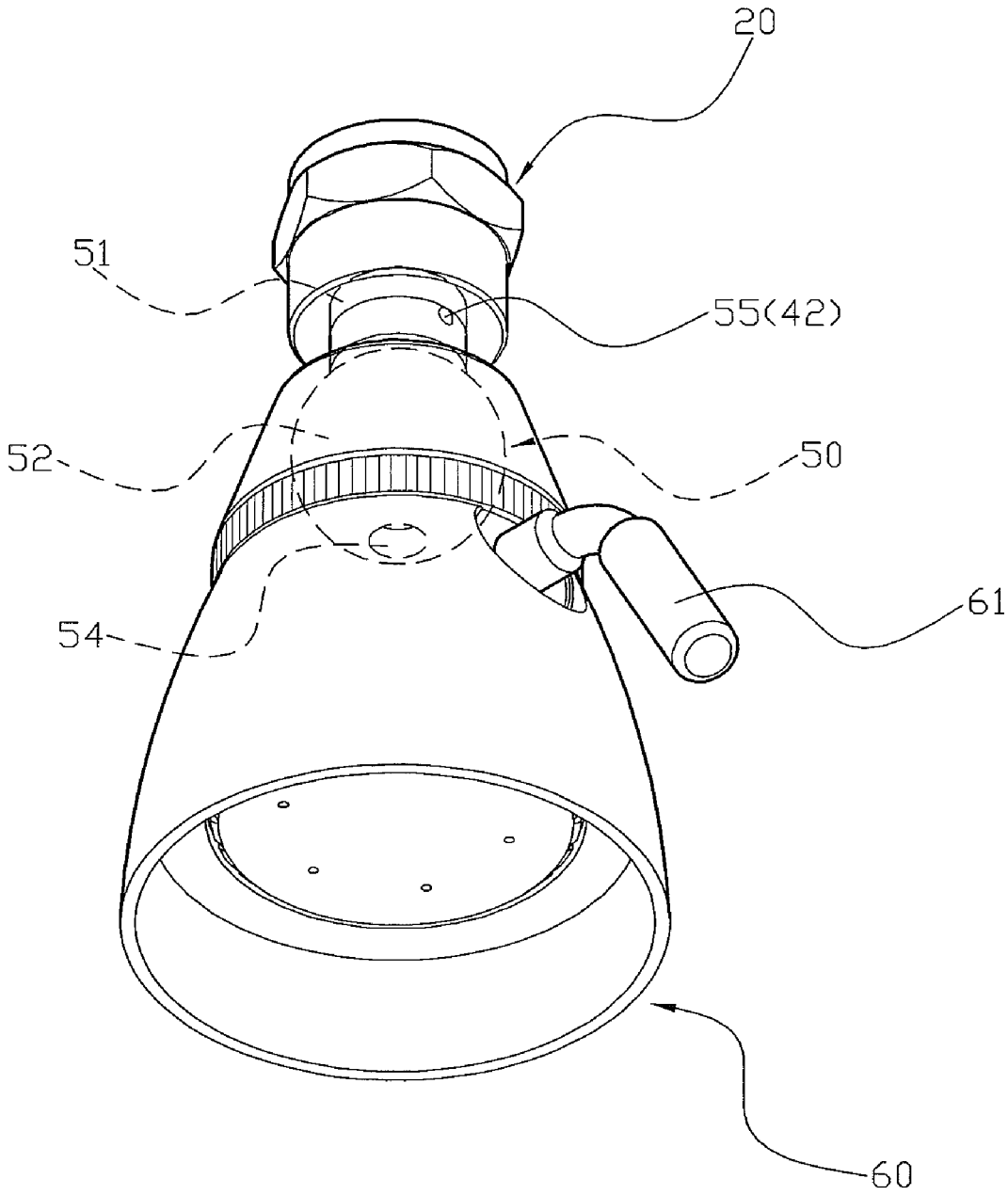
FIG. 1 is a perspective view of a shower head in accordance with the preferred embodiment of the present invention.
Figure 2:
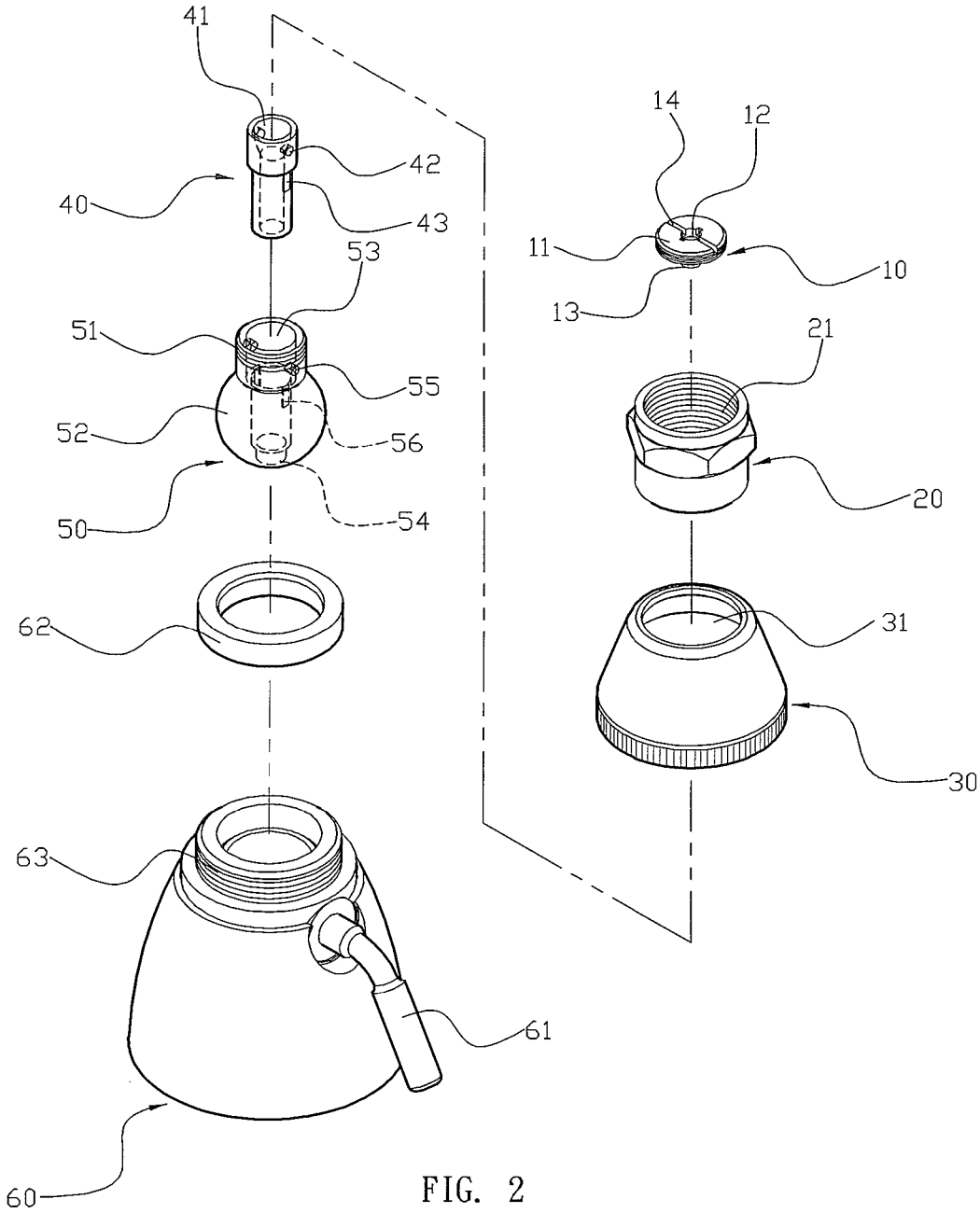
FIG. 2 is an exploded perspective view of the shower head as shown in FIG. 1.
Figure 3:
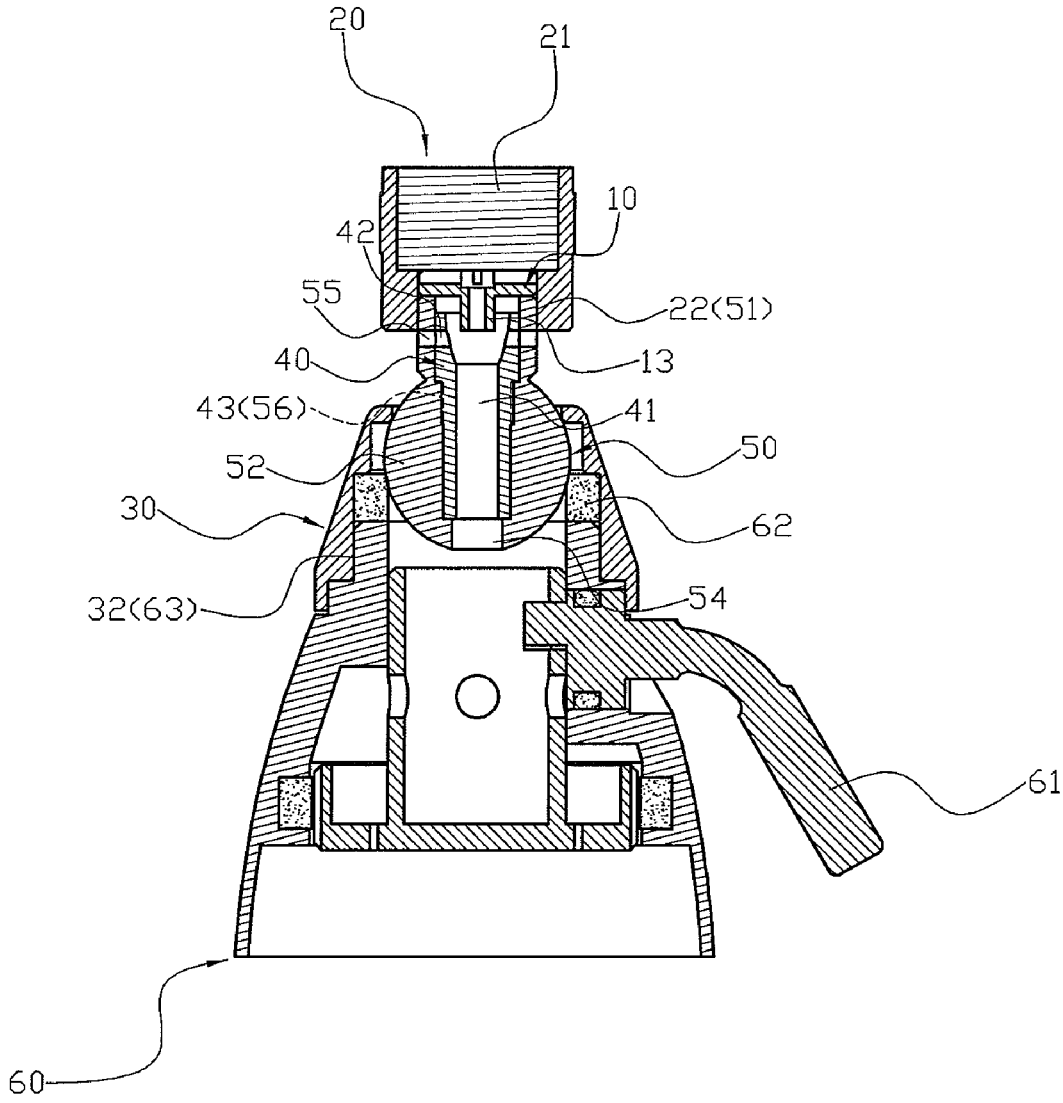
FIG. 3 is a front cross-sectional view of the shower head as shown in FIG. 1.

Referring to the drawings and initially to FIGS. 1-3, a shower head in accordance with the preferred embodiment of the present invention comprises a nozzle 60, a connector 50 mounted on an open top of the nozzle 60, a sealing ring 62 mounted in the open top of the nozzle 60 and located between the connector 50 and the nozzle 60, a fastening member 30 secured on the open top of the nozzle 60 and abutting the connector 50 to limit the connector 50 on the nozzle 60, a bushing 40 mounted in the connector 50, and a locking screw member 20 locked onto the connector 50.

The nozzle 60 has a peripheral wall provided with a control handle 61 to regulate a water flow injected from the nozzle 60. The open top of the nozzle 60 has an outer portion formed with an outer threaded portion 63.

The connector 50 has a first end provided with a spherical body 52 rotatably mounted on the open top of the nozzle 60 and abutting the sealing ring 62 and has a second end provided with a threaded tube 51. The connector 50 has an inner portion formed with a stepped mounting hole 53. The mounting hole 53 of the connector 50 extends axially through the connector 50 and has a peripheral wall formed with two radially opposite limit portions 56. Each of the limit portions 56 of the connector 50 is an elongate slot which extends axially in the mounting hole 53 of the connector 50. The mounting hole 53 of the connector 50 has a bottom formed with a reduced water outlet 54 which has a diameter smaller than that of the mounting hole 53. The connector 50 has a peripheral wall formed with two radially opposite air conducting holes 55. The air conducting holes 55 of the connector 50 are connected to the mounting hole 53. Preferably, each of the air conducting holes 55 of the connector 50 is formed in a peripheral wall of the threaded tube 51 and is spaced from an outer threading of the threaded tube 51. Each of the air conducting holes 55 of the connector 50 is disposed between the outer threading of the threaded tube 51 and the spherical body 52.

The fastening member 30 has an inner wall formed with an inner threaded portion 32 screwed onto the outer threaded portion 63 of the nozzle 60 to lock the fastening member 30 onto of the nozzle 60. The fastening member 30 has a top formed with a reduced limit hole 31 mounted on the spherical body 52 of the connector 50 so that the threaded tube 51 of the connector 50 protrudes outward from the limit hole 31 of the fastening member 30. The inner wall of the fastening member 30 presses an outer wall of the sealing ring 62.

The bushing 40 is a hollow stepped cylinder that is made of plastic material. The bushing 40 is fully received in the mounting hole 53 of the connector 50. The bushing 40 has an outer wall formed with two radially opposite locking portions 43 locked in the limit portions 56 of the connector 50 respectively so that the bushing 40 is positioned in the mounting hole 53 of the connector 50 exactly. The bushing 40 has an inner wall formed with a flow conduit 41 connected to the mounting hole 53 of the connector 50. Each of the locking portions 43 of the bushing 40 is an elongate rib which extends axially on the bushing 40. The flow conduit 41 of the bushing 40 extends axially through the bushing 40 and is connected between the mounting hole 53 and the water outlet 54 of the connector 50. The bushing 40 has a peripheral wall formed with two radially opposite air conducting apertures 42 aligning with the air conducting holes 55 of the connector 50 respectively. The air conducting apertures 42 of the bushing 40 are connected to the flow conduit 41.

The locking screw member 20 has a first end formed with a screw bore 22 screwed onto the threaded tube 51 of the connector 50 to lock the locking screw member 20 onto the connector 50. The locking screw member 20 has a second end formed with a water inlet port 21 that is connected to a water source (not shown). The locking screw member 20 has a bottom located above and spaced from the air conducting holes 55 of the connector 50 so that the air conducting holes 55 of the connector 50 are exposed outward from the locking screw member 20.

The shower head further comprises a stop member 10 secured in the locking screw member 20 and abutting a top of the threaded tube 51 of the connector 50 to seal the mounting hole 53 of the connector 50 and the flow conduit 41 of the bushing 40. The stop member 10 has a first end provided with a threaded disk 11 screwed into the screw bore 22 of the locking screw member 20 and abutting the top of the threaded tube 51 of the connector 50. The stop member 10 has a second end provided with a flow tube 13 which is extended into the flow conduit 41 of the bushing 40. The stop member 10 is located between the water inlet port 21 of the locking screw member 20 and the flow conduit 41 of the bushing 40. The stop member 10 has an inner portion formed with a through hole 12 which is connected between the water inlet port 21 of the locking screw member 20 and the flow conduit 41 of the bushing 40. The through hole 12 of the stop member 10 extends axially through the threaded disk 11 and the flow tube 13 of the stop member 10. The stop member 10 has a top face formed with an elongate tool insertion slit 14 to allow insertion of a hand tool (not shown), such as a screwdriver and the like. In assembly, when the threaded disk 11 of the stop member 10 abuts the threaded tube 51 of the connector 50, the bottom of the locking screw member 20 is located above and spaced from the air conducting holes 55 of the connector 50 as shown in FIG. 3 so that the air conducting holes 55 of the connector 50 are exposed outward from the locking screw member 20.

Figure 4:
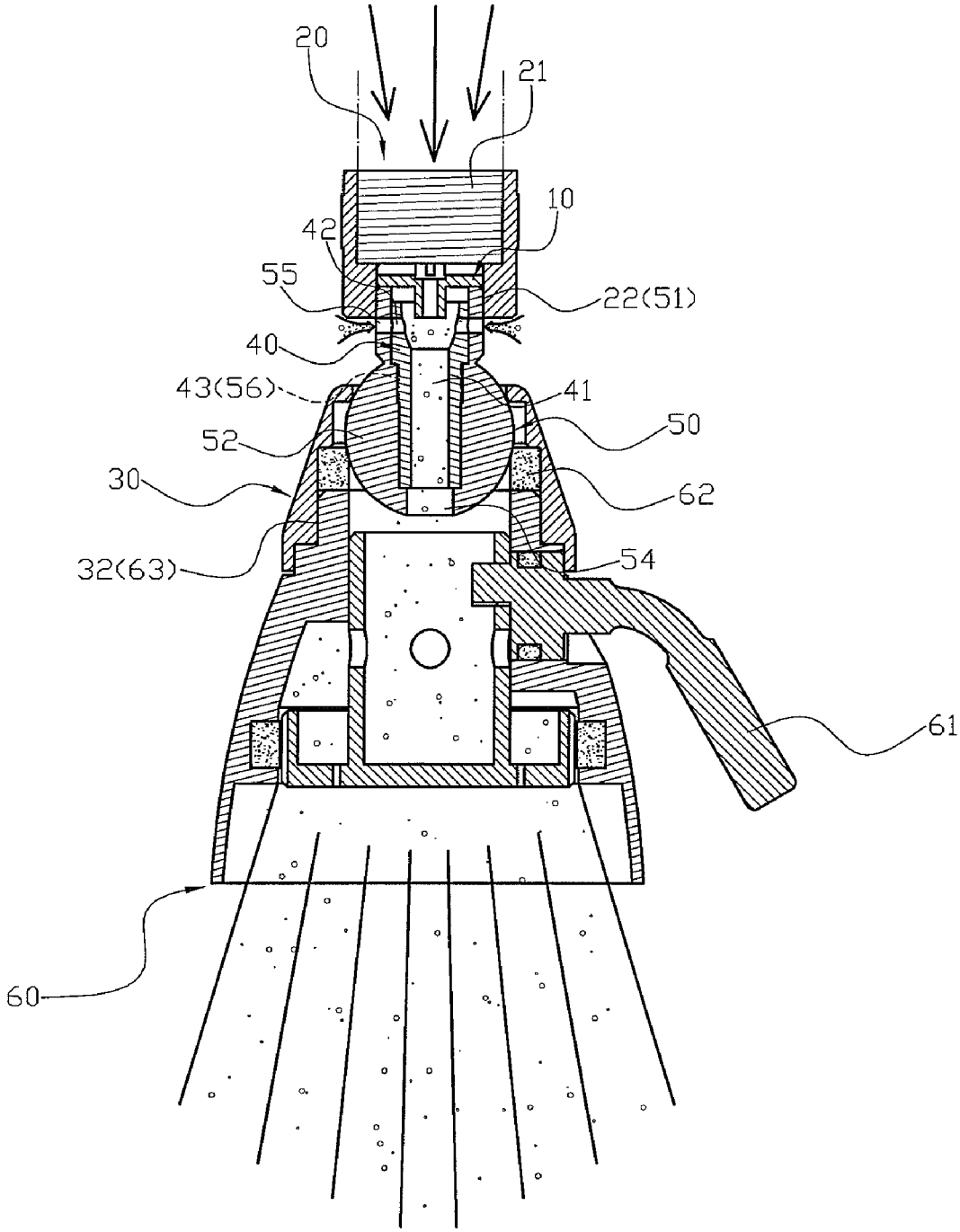
FIG. 4 is a schematic operational view of the shower head as shown in FIG. 3 in use.
Figure 5:
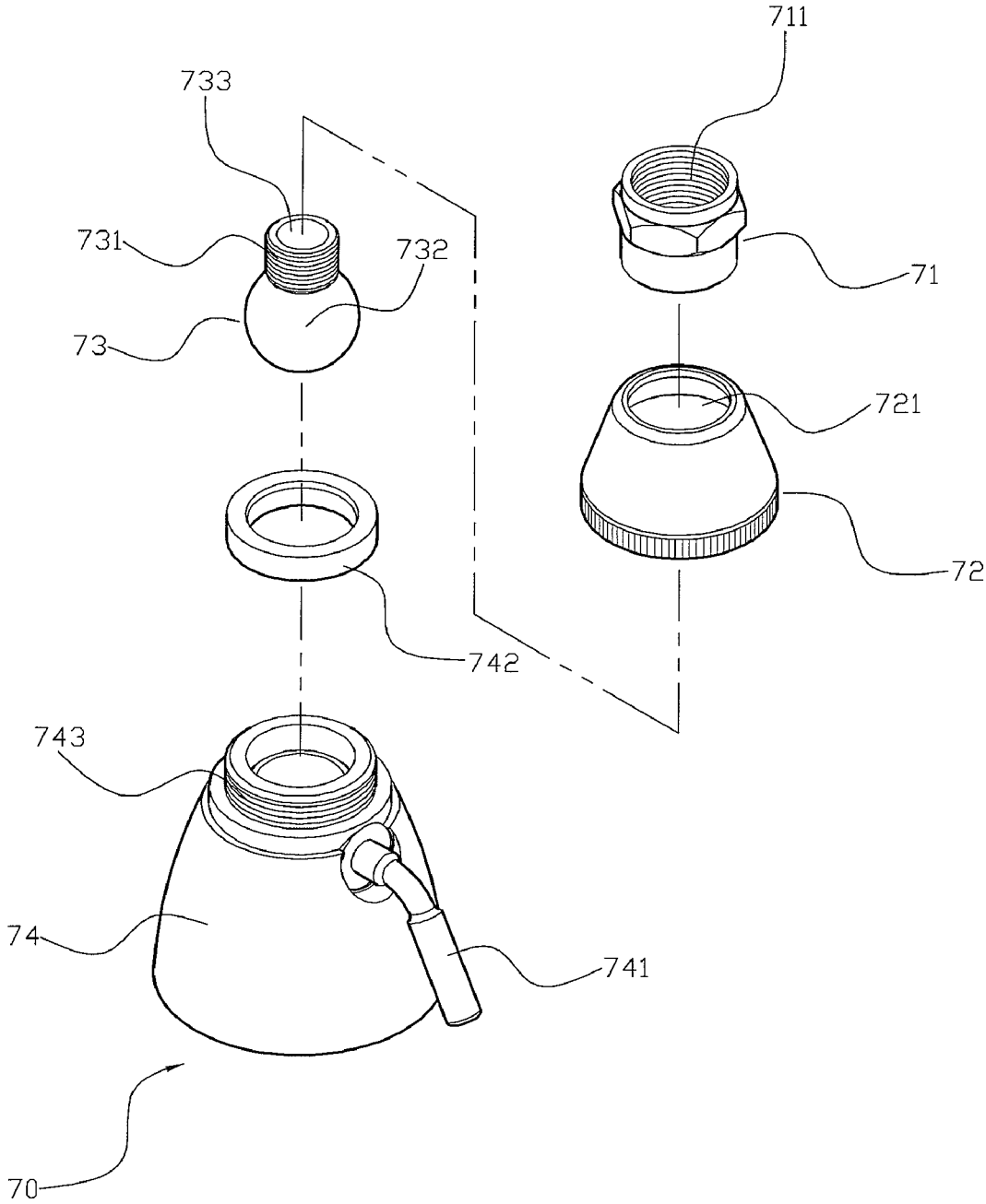
FIG. 5 PRIOR ART
FIG. 5 is an exploded perspective view of a conventional shower head in accordance with the prior art.
Figure 6:
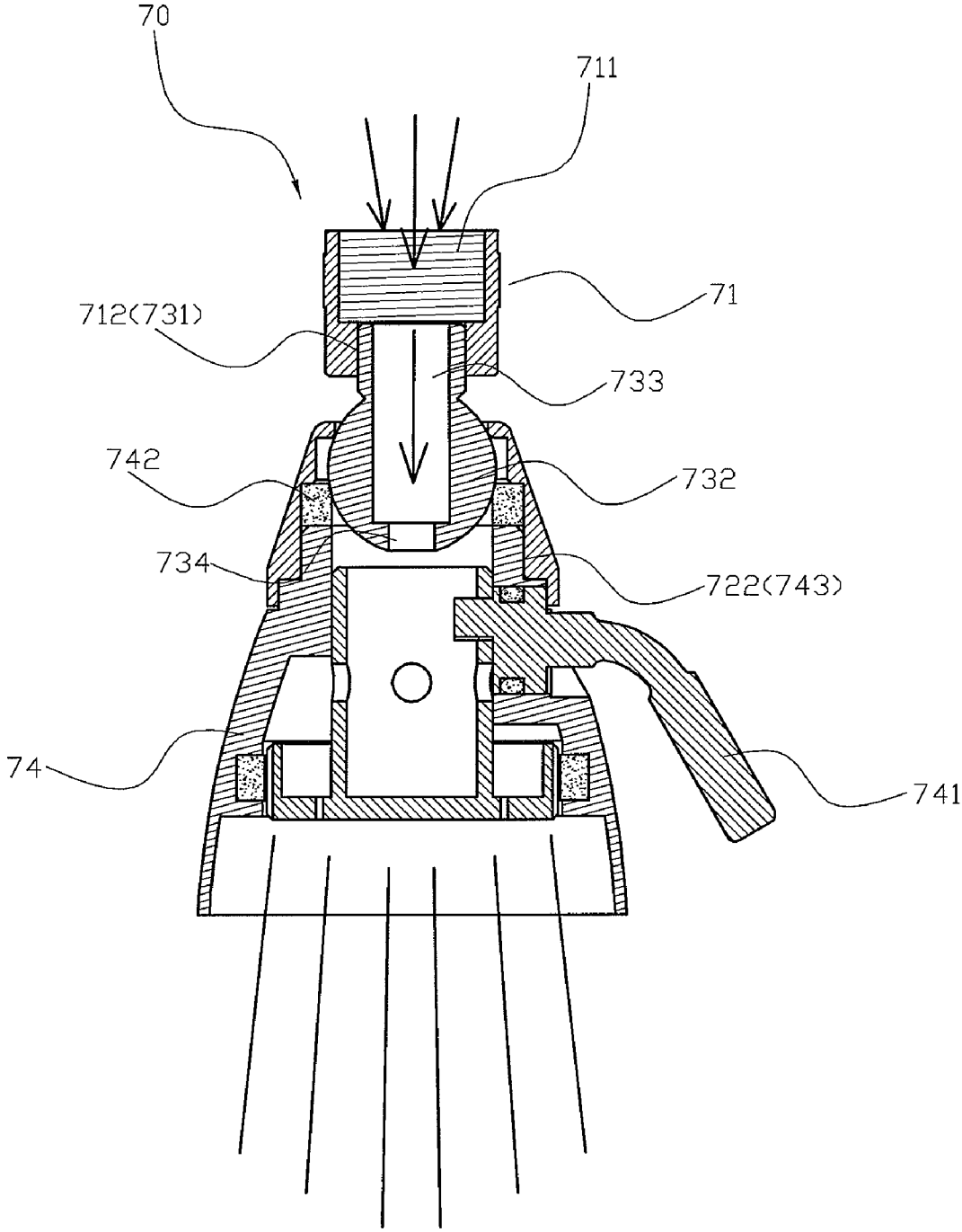
FIG. 6 PRIOR ART
FIG. 6 is a front cross-sectional operational view of the conventional shower head as shown in FIG. 5.

In operation, referring to FIGS. 3 and 4 with reference to FIGS. 1 and 2, when the water inlet port 21 of the locking screw member 20 is connected to the water source, the water from the water source in turn flows through the water inlet port 21 of the locking screw member 20, the through hole 12 of the stop member 10, the flow tube 13 of the stop member 10, the flow conduit 41 of the bushing 40 and the water outlet 54 of the connector 50 into the nozzle 60 and is injected outward from the nozzle 60 for use with a user.

At this time, the air conducting apertures 42 of the bushing 40 align with the air conducting holes 55 of the connector 50 respectively so that the ambient air is introduced through the air conducting holes 55 of the connector 50 and the air conducting apertures 42 of the bushing 40 into the flow conduit 41 of the bushing 40 to break the vacuum state in the shower head and to perturb the water flow in the shower head so as to produce a turbulent flow in the shower head so that the water flow injected from the nozzle 60 is broken and divided into multiple straight water beams and multiple irregular water bubbles as shown in FIG. 4 so as to increase the flushing angle and area of the shower head.

Accordingly, when the water flows through the shower head, the ambient air is introduced through the air conducting holes 55 of the connector 50 and the air conducting apertures 42 of the bushing 40 into the flow conduit 41 of the bushing 40 to break the vacuum state in the shower head and to perturb the water flow in the shower head so as to produce a turbulent flow in the shower head so that the water flow injected from the nozzle 60 is broken and divided into multiple straight water beams and multiple irregular water bubbles so as to increase the flushing angle and area of the shower head and to enhance the water flushing effect of the shower head. In addition, the ambient air is introduced through the air conducting holes 55 of the connector 50 and the air conducting apertures 42 of the bushing 40 into the flow conduit 41 of the bushing 40 to reduce the water pressure in the shower head so that the water is injected from the nozzle 60 smoothly and stably so as to provide a comfortable sensation to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shower head, comprising:

a nozzle;

a connector mounted on an open top of the nozzle;

a sealing ring mounted in the open top of the nozzle and located between the connector and the nozzle;

a fastening member secured on the open top of the nozzle and abutting the connector to limit the connector on the nozzle;

a bushing mounted in the connector;

a locking screw member locked onto the connector;

wherein the open top of the nozzle has an outer portion formed with an outer threaded portion;

the connector has a first end provided with a spherical body rotatably mounted on the open top of the nozzle;

the connector has a second end provided with a threaded tube;

the connector has an inner portion formed with a mounting hole;

the mounting hole of the connector has a peripheral wall formed with two radially opposite limit portions;

the connector has a peripheral wall formed with two radially opposite air conducting holes;

the air conducting holes of the connector are connected to the mounting hole;

the fastening member has an inner wall formed with an inner threaded portion screwed onto the outer threaded portion of the nozzle to lock the fastening member onto of the nozzle;

the fastening member has a top formed with a limit hole mounted on the spherical body of the connector;

the bushing is received in the mounting hole of the connector;

the bushing has an outer wall formed with two radially opposite locking portions locked in the limit portions of the connector respectively;

the bushing has an inner wall formed with a flow conduit connected to the mounting hole of the connector;

the bushing has a peripheral wall formed with two radially opposite air conducting apertures aligning with the air conducting holes of the connector respectively;

the air conducting apertures of the bushing are connected to the flow conduit;

the locking screw member has a first end formed with a screw bore screwed onto the threaded tube of the connector to lock the locking screw member onto the connector;

the locking screw member has a second end formed with a water inlet port.

2. The shower head of claim 1, wherein the shower head further comprises a stop member secured in the locking screw member and abutting a top of the threaded tube of the connector to seal the mounting hole of the connector and the flow conduit of the bushing;

the stop member has a first end provided with a threaded disk screwed into the screw bore of the locking screw member and abutting the top of the threaded tube of the connector;

the stop member has a second end provided with a flow tube which is extended into the flow conduit of the bushing;

the stop member is located between the water inlet port of the locking screw member and the flow conduit of the bushing;

the stop member has an inner portion formed with a through hole which is connected between the water inlet port of the locking screw member and the flow conduit of the bushing;

the through hole of the stop member extends axially through the threaded disk and the flow tube of the stop member;

the stop member has a top face formed with an elongate tool insertion slit;

the locking screw member has a bottom located above and spaced from the air conducting holes of the connector so that the air conducting holes of the connector are exposed outward from the locking screw member.

3. The shower head of claim 1, wherein the mounting hole of the connector has a bottom formed with a reduced water outlet which has a diameter smaller than that of the mounting hole;

the flow conduit of the bushing is connected between the mounting hole and the water outlet of the connector;

each of the air conducting holes of the connector is formed in a peripheral wall of the threaded tube and is spaced from an outer threading of the threaded tube;

each of the air conducting holes of the connector is disposed between the outer threading of the threaded tube and the spherical body;

the mounting hole of the connector extends axially through the connector.

4. The shower head of claim 1, wherein each of the limit portions of the connector is an elongate slot which extends axially in the mounting hole of the connector;

each of the locking portions of the bushing is an elongate rib which extends axially on the bushing;

the bushing is a hollow stepped cylinder;

the flow conduit of the bushing extends axially through the bushing.

* * * * *